US006364604B1

(12) United States Patent
Nonaka et al.

(10) Patent No.: US 6,364,604 B1
(45) Date of Patent: Apr. 2, 2002

(54) VACUUM PUMP AND VACUUM APPARATUS EQUIPPED WITH VACUUM PUMP

(75) Inventors: Manabu Nonaka; Takashi Okada, both of Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/347,355

(22) Filed: Jul. 6, 1999

(30) Foreign Application Priority Data

Jul. 7, 1998 (JP) ..... 10-208584

(51) Int. Cl.[7] ..... F03B 5/00
(52) U.S. Cl. ..... 415/90; 415/111; 417/423.14
(58) Field of Search ..... 415/111, 90; 417/420, 417/423.14

(56) References Cited

U.S. PATENT DOCUMENTS 4,023,920 A * 5/1977 Bachler et al. ..... 417/420

FOREIGN PATENT DOCUMENTS

JP 02114796 9/1990

* cited by examiner

*Primary Examiner*—Edward K. Look
*Assistant Examiner*—James M McAleenan
(74) *Attorney, Agent, or Firm*—Adams & Wilks

(57) ABSTRACT

A vacuum pump has an inner cylinder having a hollow portion in fluid communication with atmospheric air, an inner flange disposed on an upper side of the inner cylinder, and an inner sealing groove disposed on an upper end surface of the inner flange. An outer cylinder is disposed over the inner cylinder. The outer cylinder has an outer flange disposed on an upper side of the outer cylinder and an outer sealing groove disposed on an upper end surface of the outer flange. An intake port is disposed at the upper side of the inner and outer cylinders. An exhaust port is disposed at lower sides of the inner and outer cylinders. A pump mechanism pumps gaseous molecules from the intake port to the exhaust port to discharge the gaseous molecules from the exhaust port.

28 Claims, 12 Drawing Sheets

PRIOR ART

PRIOR ART

PRIOR ART

PRIOR ART

PRIOR ART

VACUUM PUMP AND VACUUM APPARATUS EQUIPPED WITH VACUUM PUMP

BACKGROUND OF THE INVENTION

1) Field of the Invention

The present invention relates to a vacuum pump and a vacuum apparatus equipped with the vacuum pump.

2) Description of the Related Art

In a case where dry etching, CVD, spattering, ion injection, etc. are performed in a semiconductor manufacturing apparatus, a liquid crystal manufacturing apparatus, etc., a vacuum pump such as a turbo molecular pump is widely used to perform vacuum processing by discharging the processing gas within a chamber.

FIG. 8 shows a typical turbo molecular pump which has been used.

As shown in FIG. 8, the turbo molecular pump has stator vanes and rotor vanes which are respectively disposed on a stator portion and a rotor portion in multiple stages in an axial direction, so that by rotating the rotor portion at a high speed with a motor an exhaust (vacuum) action occurs from an intake port side, i.e. the upper side in the drawing, to an exhaust port side, i.e. the left and lower side of the drawing.

FIG. 9 shows a typical vacuum apparatus in which the turbo molecular pump of this type is mounted to a chamber.

As illustrated, the vacuum apparatus has a stage 12 which is located within a chamber (container) 10 so that a sample 11 or the like can be placed on the stage 12, and a drive mechanism 13 which is located below the stage 12 and outside the chamber 10 so as to rotate the stage 12 or perform other functions. A turbo molecular pump 15 is mounted from the outside of the chamber 10 onto an exhaust port 14 portion located at the lower surface (or side surface) of the chamber so as to discharge the gas existing within the chamber 10.

However, if the sample 11 occupies a certain degree of area, the pressure in a side A closer to the turbo molecular pump 15 is lower, whereas the pressure in a side B farther therefrom is higher since the turbo molecular pump 15 is situated away from a center of the sample 11. That is, non-uniform pressure distribution is created in the vicinity of the sample 11.

Such non-uniform pressure distribution within the chamber 10 results in non-uniformity in various conditions such as a manufacturing condition, a reaction condition, a measurement condition for the sample 11. In particular, in case of the semiconductor manufacturing process, since a wafer disposed as the sample 11 on the stage 12 has been increasing in diameter recently, a pressure difference is likely to be caused around the wafer, which hinders the manufacturing of the uniform products.

In an attempt to make the pressure within the chamber 10 uniform, vacuum apparatuses of the following arrangements have been proposed.

For example, as shown in FIG. 10, a plurality of exhaust ports 14 are provided (four holes are provided in the drawing) within the chamber 10 at equidistance around the stage, and the exhaust ports 14 are connected through a branch pipe 17 to a single turbo molecular pump 15. In addition, the stage is disposed at a central position with respect to the exhaust ports 14 and the stage drive mechanism is disposed at the central portion circumscribed by the branch pipe 17 although they are not illustrated in FIG. 10 for convenience in explaining the arrangement of the piping.

By locating the exhaust ports 14 at equidistance around the sample 11 in this manner, it is possible to make the pressure around the sample 11 uniform.

As shown in FIG. 11, such a vacuum apparatus is also available that a plurality of exhaust ports 14 are provided (four holes are provided in the drawing) within the chamber 10 at equidistance around the stage, and the exhaust ports 14 are connected to respective turbo molecular pumps 15.

The vacuum apparatus thus constructed can eliminate the non-uniformity of the pressure distribution since the exhaust action is carried out by the turbo molecular pumps 15 using the plurality of exhaust ports 14 that are disposed uniformly around the sample 11.

Further, as shown in FIG. 12, such a vacuum apparatus is also available that a conductance adjustment plate 18 is disposed between the stage 12 and the exhaust port 14 within the chamber 10.

Only one exhaust port 14 is provided in this vacuum apparatus, but since the conductance adjustment plate 18 serves as a resisting plate against the exhaust or discharge flow, it is possible to suppress the non-uniformity in pressure distribution within the chamber 10.

The vacuum apparatus shown in FIG. 10, however, requires the turbo molecular pump 15 to be disposed at such a position as to avoid the interference with the drive mechanism that is located in the chamber 10. Accordingly, the branch pipe 17 is also required to be led to the turbo molecular pump 15 while avoiding the interference with the drive mechanism. This restriction in piping design is likely to cause the non-uniform conductance (exhaust resistance) of the pipe, and thus it is required to additionally install a pressure adjusting valve at a location midway of the pipe or to partially modify the length or diameter of the pipe, which results in an increase in cost.

Further, the turbo molecular pump 15 of a larger exhaust speed is required due to the conductance of the branch pipe 17, and the entire cost for the apparatus is increased accordingly.

Moreover, although the vacuum apparatus shown in FIG. 10 is advantageous over the vacuum apparatus shown in FIG. 9 from the viewpoint of the uniform pressure distribution, the provision of only four exhaust ports 14 cannot solve such a pressure non-uniformity problem that a pressure difference is caused between the vicinity of each exhaust port 14 and the intermediate position between an adjacent exhaust ports 14 and 14. The provision of the increased number of exhaust ports 14 and the pipes may solve this non-uniformity problem, but such will further increase the cost.

In the case of the vacuum apparatus shown in FIG. 11, since an independent turbo molecular pump 15 is installed for a respective exhaust port 14, the apparatus is free from the increase of conductance due to the use of the branch pipe, but suffers from a problem in that the provision of the plurality of turbo molecular pumps results in the higher cost in comparison to the provision of the branch pipe. Further, similarly to the vacuum apparatus shown in FIG. 10, the apparatus encounters the pressure non-uniformity problem in which a pressure difference is caused between the vicinity of each exhaust port 14 and the intermediate position between the adjacent exhaust ports 14 and 14.

In the case of the vacuum apparatus shown in FIG. 12, the provision of the conductance adjusting plate 18 increases the cost, and is insufficient to effectively eliminate the non-uniformity of the pressure distribution.

SUMMARY OF THE INVENTION

Accordingly, a primary object of the present invention is to provide a vacuum pump of a novel arrangement, which can eliminate the non-uniformity of the pressure distribution around the stage.

A secondary object of the present invention is to provide a vacuum apparatus of a novel arrangement, which can eliminate the non-uniformity of the pressure distribution around the stage.

According to a first aspect of the present invention, there is provided a vacuum pump which comprises: an outer casing including an inner cylinder having a hollow portion inside thereof, the hollow portion being communicated with an atmospheric air and capable of accommodating a device therein, an outer cylinder disposed outside the inner cylinder, and a bottom surface plate closing a gap between the outer cylinder and the inner cylinder at one end side; an exhaust port disposed at the one end side of the outer casing; a rotor main body disposed between the inner cylinder and the outer cylinder; a bearing supporting the rotor main body; a motor which rotates the rotor main body, the motor being disposed between the inner cylinder and the rotor main body or between the outer cylinder and the rotor main body; and a pump mechanism which carries gaseous molecule from an intake port disposed at the other end side of the outer casing and discharges the gaseous molecule from the exhaust port, the pump mechanism being disposed between the inner cylinder and the rotor main body or between the outer cylinder and the rotor main body, to thereby achieve the primary object.

According to a second aspect of the present invention, in a vacuum pump as set forth in the first aspect of the present invention, a non-contact sealing mechanism is disposed at least on one of the one end side and the other end side so that a reverse flow of the gaseous molecule to the side where the pump mechanism is not disposed, between the inner cylinder and the rotor main body or between the outer cylinder and the rotor main body, is prevented.

According to a third aspect of the present invention, there is provided a vacuum pump comprising: an outer casing including an inner cylinder having a hollow portion inside thereof, the hollow portion being communicated with an atmospheric air and capable of accommodating a device therein, an intermediate cylinder disposed outside the inner cylinder, an outer cylinder disposed outside the intermediate cylinder, and a bottom surface plate closing a gap between the inner cylinder and the intermediate cylinder and a gap between the intermediate cylinder and the outer cylinder at one end side; an exhaust port disposed at the one end side of the outer casing; a communication hole disposed at the one end side of the intermediate cylinder; a rotor main body including an inner rotor main body disposed between the inner cylinder and the intermediate cylinder, an outer rotor main body disposed between the intermediate cylinder and the outer cylinder, and a connection plate connecting the inner rotor main body and the outer rotor main body to each other at an upper side of the intermediate cylinder; a bearing supporting the rotor main body; a motor which rotates the rotor main body, the motor being disposed between the intermediate cylinder and the inner rotor main body or between the intermediate cylinder and the outer rotor main body; and a pump mechanism which carries gaseous molecule from an intake port disposed at the other end side of the outer casing and discharges the gaseous molecule from the exhaust port, the pump mechanism being disposed between the inner rotor main body and the inner cylinder or between the outer rotor main body and the outer cylinder, to thereby achieve the object.

According to a fourth aspect of the present invention, in a vacuum pump as set forth in any one of the first to third aspects of the present invention, the pump mechanism applies vector momentum to the gaseous molecule using a threaded groove mechanism, a blade disposed on the rotor main body, a disk disposed on the rotor main body or a combination thereof, to thereby discharge the gaseous molecule.

According to a fifth aspect of the present invention, in a vacuum pump as set forth in any one of the first to third aspects of the present invention, the pump mechanism includes a volume transferring type pump mechanism.

According to a sixth aspect of the present invention, in a vacuum pump as set forth in any one of the first to fifth aspects of the present invention, the bearing includes a magnetic bearing.

According to a seventh aspect of the present invention, there is provided a vacuum apparatus using a vacuum pump as set forth in any one of the first to sixth aspects, the vacuum apparatus comprising: a container having an annular exhaust port; a stage disposed inside the exhaust port within the container; a stage drive mechanism disposed outside the container; and the vacuum pump in which the drive mechanism is accommodated within the hollow portion, wherein the one end side is mounted to the container such that the exhaust port is communicated with the intake port, to thereby achieve the secondary object.

BRIEF DESCRIPTION OF THE DRAWINGS

In the accompanying drawings:

FIGS. 1(*a*) and 1(*b*) show a turbo molecular pump which constitutes a first embodiment of a vacuum pump according to the present invention, in which

DETAILED DESCRIPTION OF THE PREFERRED EMBODIMENTS

Hereinafter, preferred embodiments of the present invention will now be described in detail with reference to FIGS. 1 to 7.

Figures 1A, 1B:
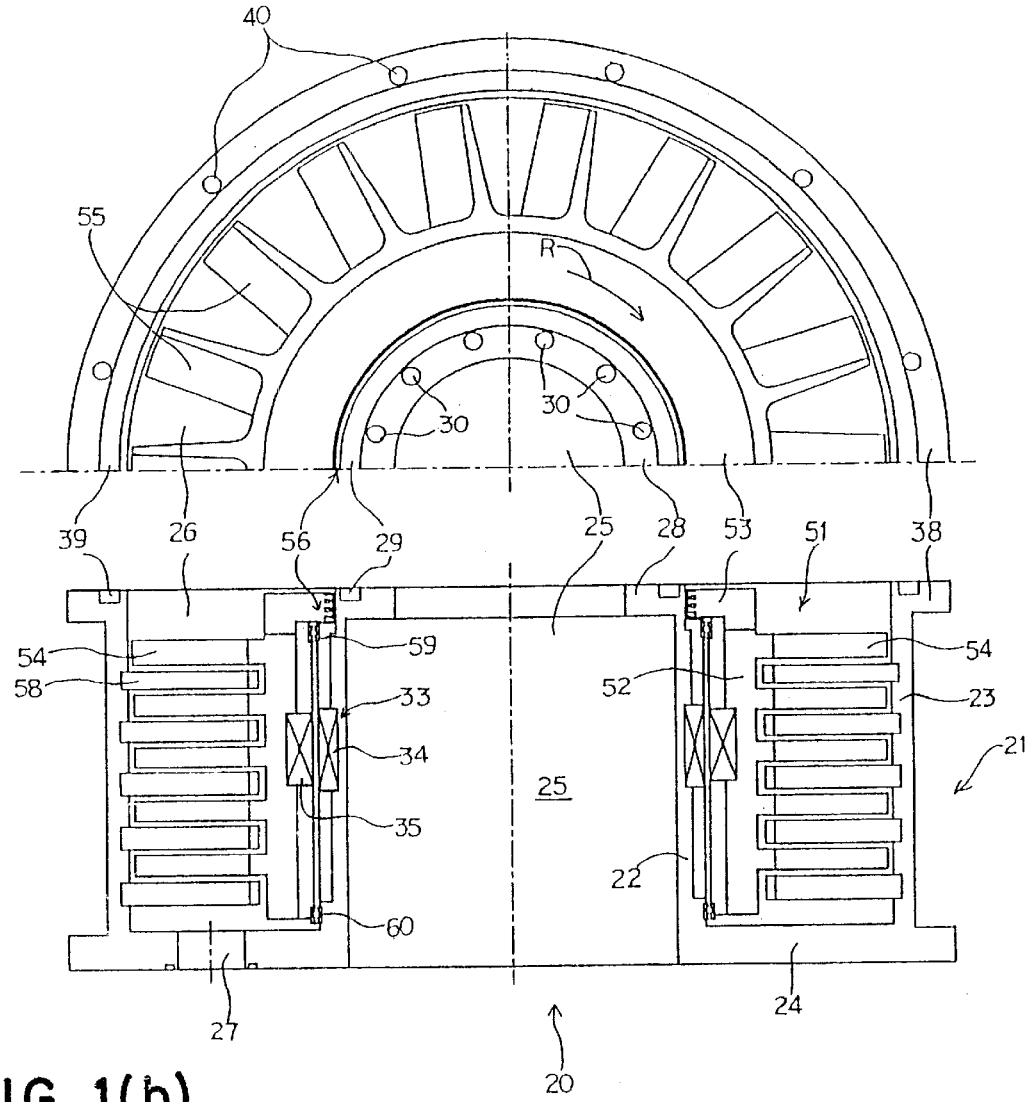
FIG. 1*a* shows a front half of the turbo molecular pump.
FIG. 1*b* shows a cross-section thereof.

FIGS. 1(*a*) and 1(*b*) shows an arrangement of a turbo molecular pump, i.e. an example of a vacuum pump, which constitutes an embodiment of the present invention. FIG. 1(*a*) shows a front half of the turbo molecular pump, and FIG. 1(*b*) shows a cross-section thereof.

As shown in FIGS. 1(*a*) and 1(*b*), a turbo molecular pump 20 is provided with an outer casing 21 the outer circumferential surface of which is exposed to the atmospheric air. The outer casing 21 has an inner cylinder 22 the inner circumferential wall of which is exposed to the atmospheric air, an outer cylinder 23 the outer circumferential wall of which is exposed to the atmospheric air, and a bottom surface annular plate 24 in the form of annulus. The outer casing 21 is in the form of a hollow circular column as a whole, and defines a hollow portion 25 surrounded by the inner circumferential wall of the inner cylinder 22. A stage drive mechanism, a cable, and so on are accommodated within this hollow portion 25.

An intake port 26 is defined between the inner cylinder 22 and the outer cylinder 23 to communicate with an exhaust port of a chamber.

As illustrated in FIGS. 1(*a*) and 1(*b*), the bottom surface annular plate 24 is disposed on the lower sides (i.e. the downstream side with respect to the exhaust action) of the inner and outer cylinders 22 and 23, and fixed thereto by welding or integrally formed thereto. The bottom surface annular plate 24 is formed with a circular exhaust port 27 (in this embodiment, one circular exhaust port is provided, but a plurality of circular exhaust ports may be provided) so as to discharge therefrom the processing gas or the like which has been aspirated into the chamber through the intake port 26.

The exhaust port 27 is formed in the bottom surface annular plate 24 in this embodiment, but may be formed in other portions such as lower portions of the outer cylinder 23 and the inner cylinder 22.

The inner diameter of the inner cylinder 22 is set to be, for instance, 400 mm in this embodiment although it depends on the design specification.

An inner flange 28 is provided on the end of the upper side (i.e. the upstream side with respect to the exhaust action) of the inner cylinder 22 to elongate radially inwardly therefrom. An annular, inner sealing groove 29 is formed on the upper end surface of the inner flange 28 along the entire periphery thereof for sealing between the inside of the chamber and the atmospheric air. An O-ring or a metal seal is disposed in this inner sealing groove 29.

A plurality of bolt holes 30 are formed through the inner flange 28 and arranged at constant angular intervals so that the inner flange 28 can be coupled by bolts to a chamber, and a mounting plate to which a stage is mounted, or the stage.

An outer-rotor-type motor 33 is disposed substantially at the axially central portion on the outer periphery of the inner cylinder 22, and a stator coil 34 is mounted to the outer peripheral wall of the inner cylinder 22. This motor 33 is designed to rotate normally at several tens of thousands r.p.m. (20,000 to 50,000 r.p.m.) although it depends on the design specification of each turbo molecular pump.

An outer flange 38 is provided on the end portion of the upper side (the upstream side with respect to the exhaust action) of the outer cylinder 23 to elongate radially outwardly therefrom. An annular, outer sealing groove 39 is formed on the upper end surface of the outer flange 38 along the entire periphery thereof for sealing between the inside of the chamber and the atmospheric air. An O-ring or a metal seal is disposed in this outer sealing groove 39.

A plurality of bolt holes 40 are formed through the outer flange 38 and arranged at constant angular intervals so that the outer flange 38 can be coupled by bolts to the chamber.

Although not shown in the drawings, the outer casing 21 is provided at a predetermined location with a connector for an electric system for driving the motor 33 and other various electric systems. For example, the connector can be mounted downwardly from the bottom surface annular plate 24, radially outwardly from the downstream side of the outer cylinder 23, or radially inwardly (i.e. toward the center of the hollow portion) from the downstream side of the inner cylinder 22.

A rotor 51 to be driven by the motor 33 is disposed between the inner and outer cylinders 22 and 23 of the outer casing 21. The rotor 51 includes a cylindrical rotor main body 52, an annular flange portion 53 disposed on the upper side of the rotor main body 52 to elongate radially inwardly therefrom, and multiple-stage rotor vanes 54 disposed on the outer peripheral wall of the rotor main body 52.

A rotor 35 of the motor 33 is mounted to the inner peripheral wall of the rotor main body to confront with the stator coil 34.

The inner peripheral wall of the flange 53, which confronts with the inner cylinder 22, is formed with a threaded groove 56. This threaded groove 56 serves as a sealing structure for preventing the reverse flow in which the processing gas discharged from the chamber flows again into the chamber from the bottom surface annular plate 24 portion through a gap between the rotor main body 52 and the inner cylinder 22 without being discharged through the exhaust port 27.

The rotor vane 54 of each stage has a plurality of rotor blades (wings) 55 open at their outer sides. Each of the rotor blades 55 extends radially and inclined at a predetermined angle with respect to the rotational axis of the rotor main body 52.

The rotor 51 in this embodiment is of an integral type in which the rotor main body 52, the flange portion 53, the rotor vanes 54 and the rotor blades 55 are integrally formed together, but it may be constructed such that the rotor vanes 54 are formed separately stage by stage and coupled together in the axial direction.

Stator vanes 58 are disposed through an axially-extending, cylindrical spacer (not-shown) onto the inner peripheral surface of the outer cylinder 23 so as to form the axially multiple-stage construction.

The stator vane 58 of each stage is divided into two sections in the circumferential direction so that it can be assembled by inserting those sections into a space between the adjacent rotor vanes 54 from the outer peripheral side.

The stator vane 58 includes an inner annular portion, an outer annular portion the outer peripheral side of which is partially clamped by the spacer along the circumferential direction, and a plurality of stator blades each supported by the inner and outer annular portions to extend radially with a predetermined angle. The inner diameter of the inner annular portion is larger than the outer diameter of the rotor main body 52, so that the inner peripheral surface of the inner annular portion is prevented from being contacted with the outer peripheral surface of the rotor main body 52.

This stator vane 58 is formed such that the semi-annular outer contour portion and the stator blade portion are cut out from a circumferentially two-divided thin plate made for instance of stainless steel or aluminum by subjecting the thin plate to an etching process or the like, and the stator blade portion is bent at a predetermined angle by press processing.

A bearing 59 and a bearing 60 are disposed between the inner cylinder 22 and the rotor main body 52 so as to be located on the opposite ends with respect to the motor 33 and to receive the thrust and radial loads.

In this embodiment, rolling bearings are used as the bearings 59 and 60.

The turbo molecular pump 20 thus constructed performs the exhaust action in which the processing gas or the like within the chamber is discharged from the intake port 26 toward the exhaust port 27 when the rotor 51 is rotated at several tens of thousands r.p.m. in the direction indicated by an arrow R (in the clockwise direction in the drawing) by driving the motor 33.

Figure 2:
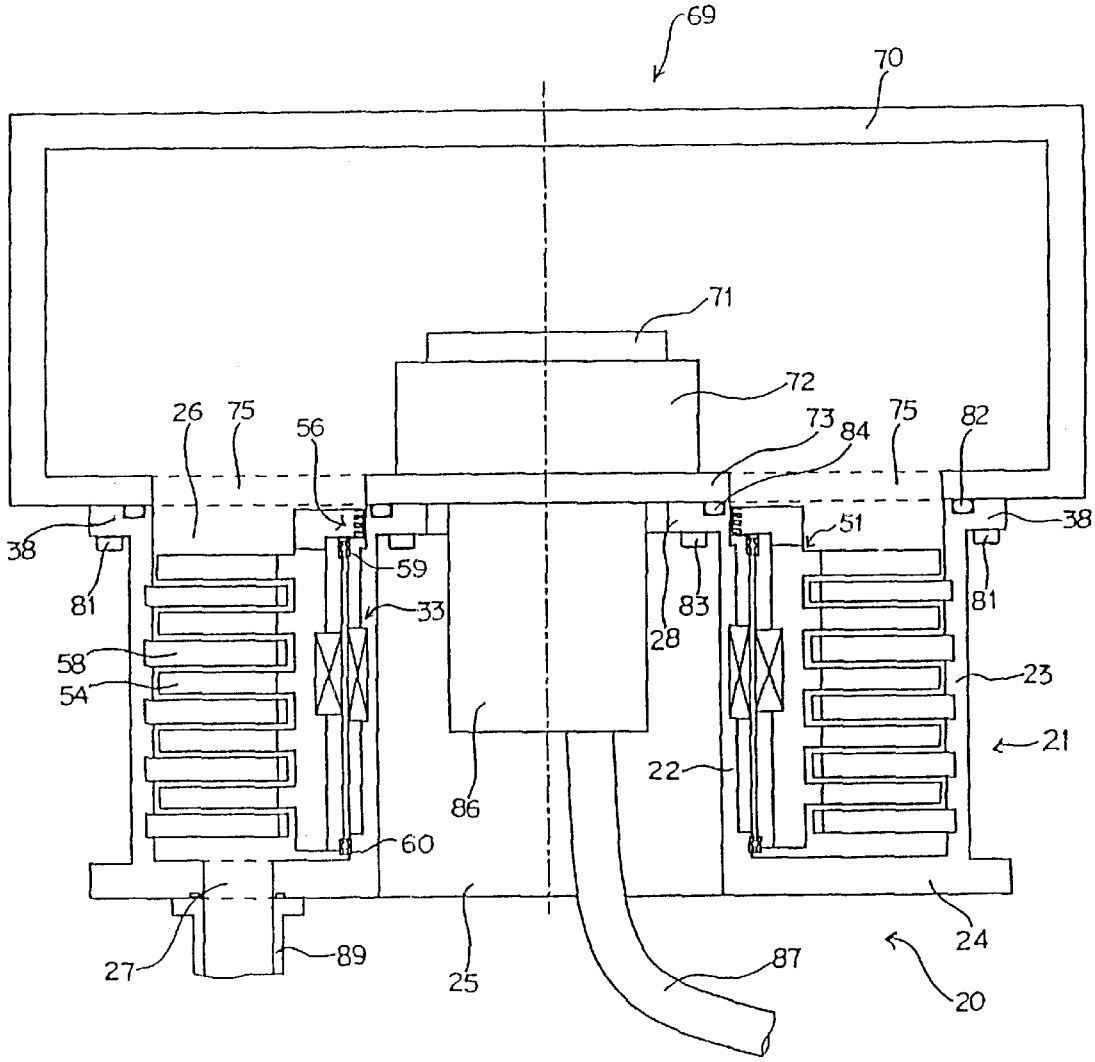
FIG. 2 is a cross-sectional view of a vacuum apparatus in which the turbo molecular pump of the first embodiment is mounted to a chamber.
Figure 3:
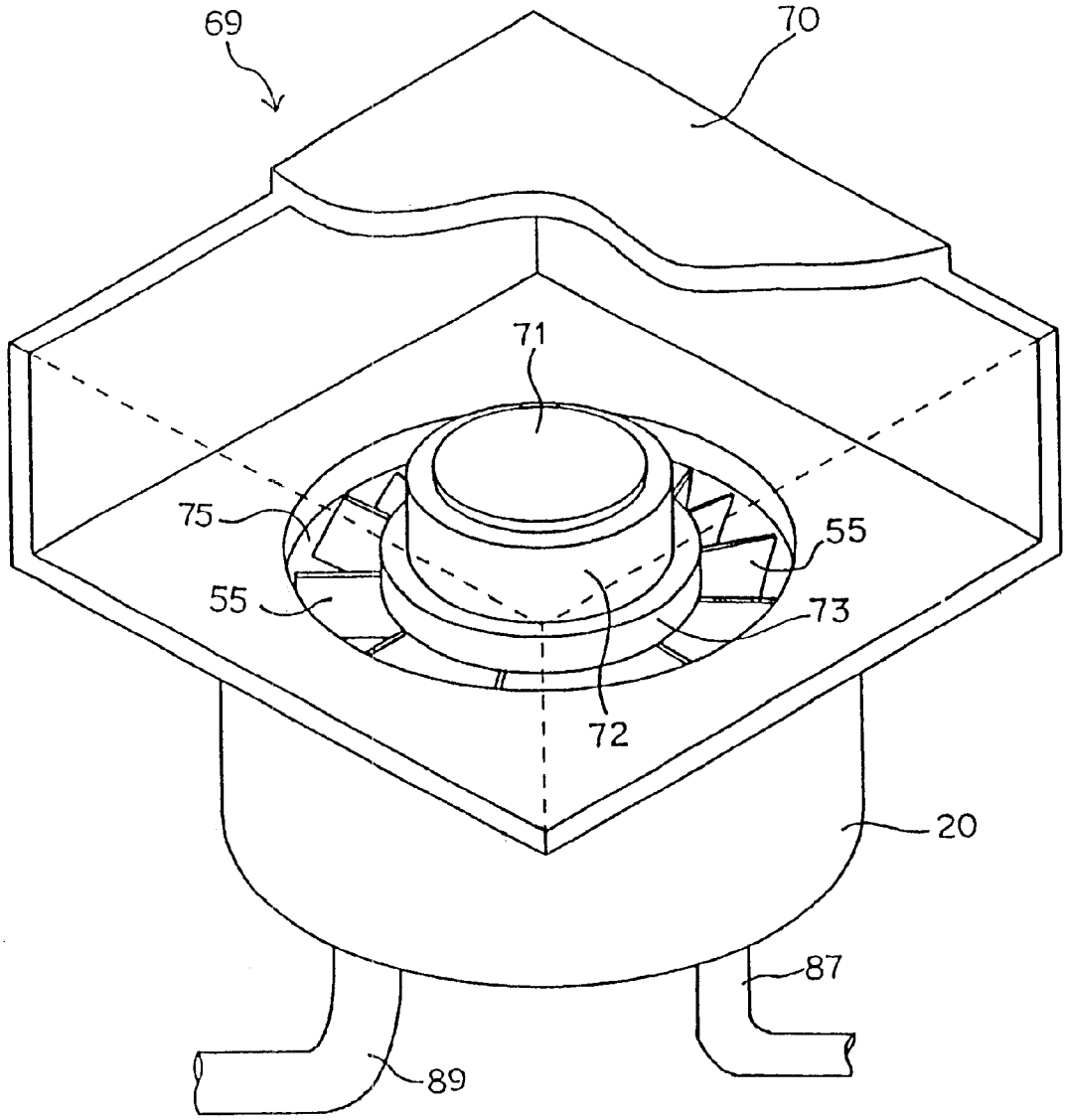
FIG. 3 is a partially-sectional, perspective view of the vacuum apparatus in which the turbo molecular pump of the first embodiment is mounted to a chamber as shown in FIG. 2.

FIG. 2 is a cross-sectional view showing a vacuum apparatus 69 in which the turbo molecular pump 20 thus constructed is mounted to the chamber. FIG. 3 is a partially-sectional perspective view of the vacuum apparatus 69.

As shown in these drawings, a stage 72 on which a sample 71 is disposed, and a circular mounting plate 73 on which the stage 72 is mounted are installed within the chamber 70.

An annular exhaust port 75 are formed along the entire periphery around the stage 72.

Bolt holes are provided around the peripheral edge portion of the exhaust port 75, which are communicated with the bolt holes 40 arranged in the outer flange 38 of the turbo molecular pump 20. The bolts 81 are used to fasten the chamber 70 onto the outer flange 38. An O-ring 82 is fitted in the outer sealing groove 39 of the outer flange 38 to realize the sealing between the chamber 70 and the outer flange 38.

Bolt holes are provided around the outer peripheral edge portion of the mounting plate 73, which are communicated with the bolt holes 30 arranged in the inner flange 28 of the turbo molecular pump 20. The bolts 83 are used to fasten the chamber 70 onto the inner flange 28. An O-ring 84 is fitted in the inner sealing groove 29 of the inner flange 28 to realize the sealing between the chamber 70 and the inner flange 28.

A drive mechanism 86 for rotating the stage 72, adjusting the temperature on the stage 72 or the like is installed on the lower side (the atmospheric air side) of the mounting plate 73. A control cable 87 is connected to the drive mechanism 86.

The drive mechanism 86 and the cable 87 are accommodated within the hollow portion 25 surrounded by the inner peripheral wall of the inner cylinder of the turbo molecular pump 20.

In the turbo molecular pump 20 and the turbo molecular pump apparatus 69 thus constructed, the motor 33 rotates the rotor 51 in the direction indicated by the arrow R at the high speed of the rated value (20,000 to 50,000 r.p.m.), to thereby rotate the rotor vanes 54 at high speed. Consequently, the processing gas or the like within the chamber 70 is discharged therefrom through the exhaust port 75 and the intake port 26 of the turbo molecular pump 20 to the lower side in the drawing by the rotor vanes 54, and thus discharged to an exhaust pipe 89 connected to the exhaust port 27.

Therefore, according to the present invention, since the processing gas or the like is uniformly discharged from the entire circumstance around the stage 72 on which the sample 71 is disposed, the pressure around the sample 71 within the chamber 70 can be made uniform.

In this embodiment, the threaded groove 56 is formed on the inner peripheral wall of the flange 53 while being confronted with the inner cylinder 22, to thereby serve as the sealing structure. Therefore, it is possible to prevent such a reverse flow that the processing gas that has been moved from the chamber 70 down to the bottom surface annular plate 24 portion will flow again into the chamber 70 through the gap between the downstream side bearing 60 or the rotor main body 52 and the inner cylinder 22 without being discharged through the exhaust port 27.

This embodiment employs the threaded groove 56 formed in the flange 53 as the sealing structure for preventing the reverse flow through the gap between the rotor main body 52 and the inner cylinder 22, but may alternatively employ a labyrinth packing using a labyrinth structure, or other various sealing structures.

Next, a second embodiment of the present invention will be described hereafter.

Figures 4A, 4B:
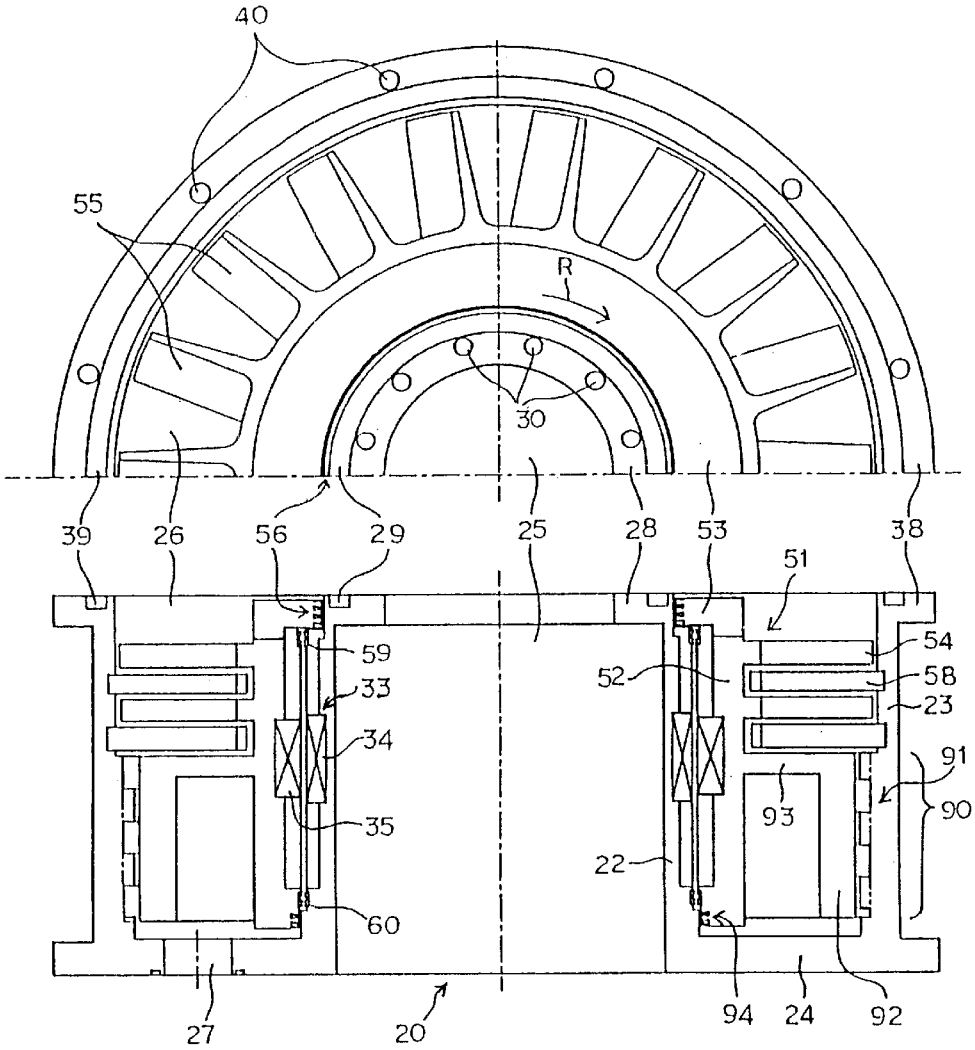
FIGS. 4(*a*) and 4(*b*) show an arrangement of a vacuum pump which constitutes a second embodiment of the present invention, in which the part FIG. 4(*a*) shows a front half of the vacuum pump, and FIG. 4(*b*) shows a cross-section thereof.

FIGS. 4(*a*) and 4(*b*) show an arrangement of a vacuum pump 20, which constitutes a second embodiment of the present invention. FIG. 4(*a*) shows a front half of the vacuum pump 20, and FIG. 4(*b*) shows a cross-section thereof. Portions corresponding to the portions which have been described in connection with the first embodiment with reference to FIGS. 1(*a*), 1(*b*) are denoted by the same reference numerals, and the description therefor is omitted accordingly.

The vacuum pump 20 according to the second embodiment of the present invention is designed to perform the exhaust action using a threaded groove pump 90 in addition to the exhaust action using the stator vanes 58 and the rotor vanes 54. That is, it is a combination of the turbo molecular pump and the threaded groove pump 90.

That is, in the first embodiment of the present invention, the rotor vanes 54 and the stator vanes 58 are alternately arranged in the multi-stages entirely in the axial direction, but in this embodiment, the rotor vanes 54 and the stator vanes 58 are formed on the upstream side, i.e. the portion down to the midway in the axial direction, and the threaded groove pump 90 is disposed on the downstream side to be continuous with the rotor vanes 54 and the stator vanes 58.

The threaded groove pump 90 has a plurality of threaded grooves 91 each having a spiral construction, which are formed on the downstream side inner diameter wall of the outer cylinder 23. A cylinder 92 confronted with the threaded grooves 91 is disposed on an annular holding plate 93 that extends radially outwardly along the outer peripheral wall of the rotor main body 52. Although the cylinder 92 and the holding plate 93 in this embodiment are formed integral with the rotor main body 52, the cylinder 92 and the holding plate 93 may be formed separately from each other and fixed to the rotor main body 52 by welding or the like.

Although the threaded grooves 91 in this embodiment are formed on the stator side (i.e. the outer cylinder 23 side), the threaded grooves may be formed on the outer diameter wall of the cylinder 92 of the rotor main body 52. Further, the threaded grooves 91 may be formed on both the outer cylinder 23 and the outer diameter wall of the cylinder 92.

In the vacuum pump 20 of this embodiment, a reverse flow preventive sealing groove 94 is formed on the inner peripheral wall of the lower end portion (downstream side relative to the bearing 60) of the rotor main body 52 in addition to the reverse flow preventive sealing groove 56 formed on the inner peripheral wall of the flange 53 and located at the upper portion of the rotor main body 52.

This makes it possible to enhance the reverse flow preventive effect.

Next, a third embodiment of the present invention will be described hereafter.

Figures 5A, 5B:
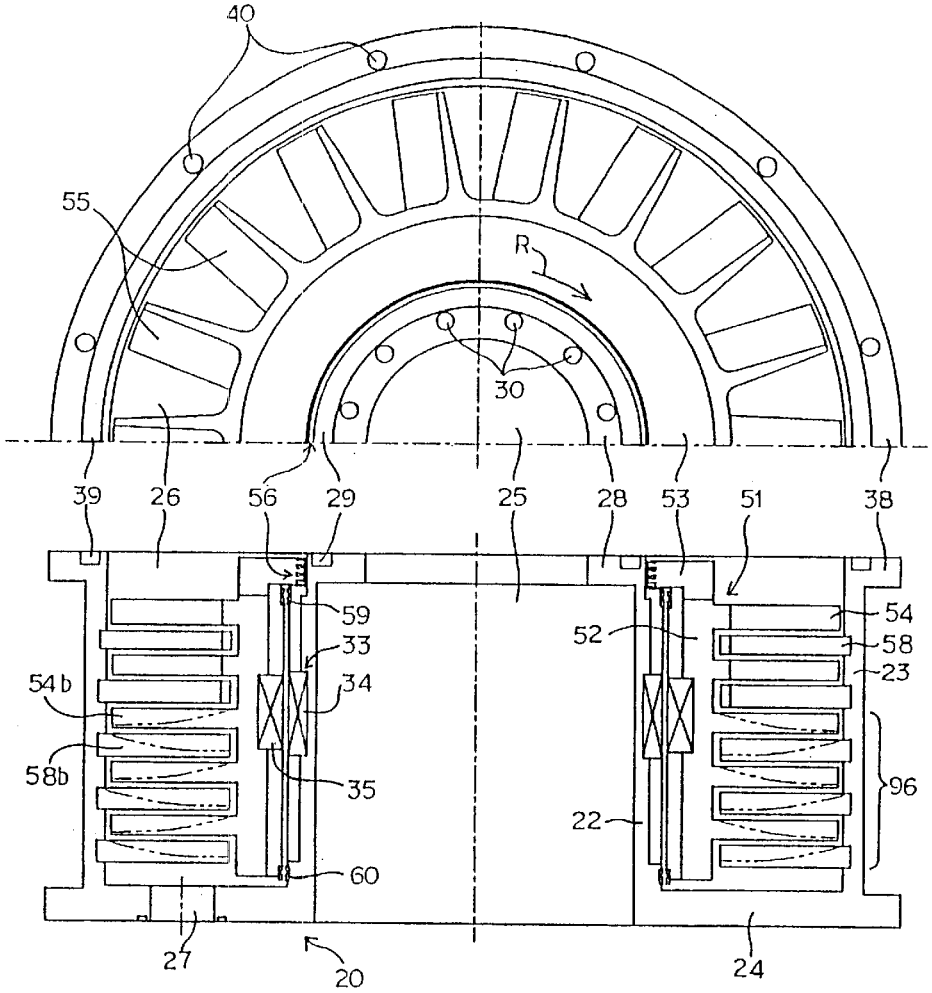
FIGS. 5(*a*) and 5(*b*) show an arrangement of a vacuum pump which constitutes a third embodiment of the present invention, in which FIG. 5(*a*) shows a front half of the vacuum pump, and FIG. 5(*b*) shows a cross-section thereof.

FIGS. 5(*a*) and 5(*b*) show an arrangement of a vacuum pump 20, which constitutes a third embodiment of the present invention. FIG. 5(*a*) shows a front half of the vacuum pump 20, and FIG. 5(*b*) shows a cross-section thereof. Portions corresponding to the portions which have been described in connection with the first embodiment with reference to FIGS. 1(*a*), 1(*b*) are denoted by the same reference numerals, and the description therefor is omitted accordingly.

The vacuum pump 20 according to the third embodiment of the present invention is designed to perform the exhaust action using a centrifugal flow type pump 96 in addition to the exhaust action using the stator vanes 58 and the rotor vanes 54. That is, it is a combination of the turbo molecular pump and the centrifugal flow type pump 96.

That is, in the third embodiment of the present invention, the rotor vanes 54 and the stator vanes 58 are formed on the upstream side, i.e. the portion down to the midway in the axial direction, and rotor vanes 54*b* and stator vanes 58*b* each being of a centrifugal disk type are alternately arranged on the downstream side in the multiple-stages to be continuous with the rotor vanes 54 and the stator vanes 58.

Next, a forth embodiment of the present invention will be described hereafter.

Figures 6A, 6B:
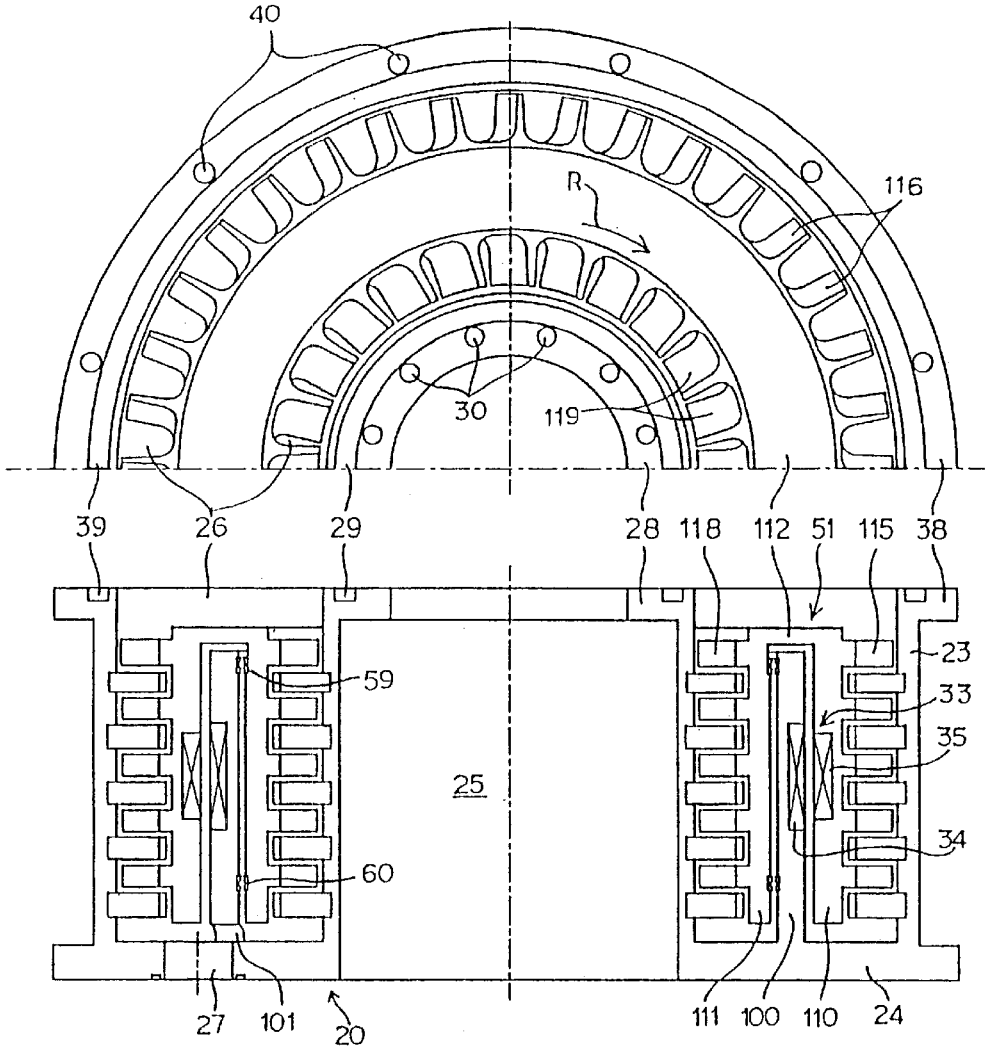
FIGS. 6(*a*) and 6(*b*) show an arrangement of a vacuum pump which constitutes a fourth embodiment of the present invention, in which FIG. 6(*a*) shows a front half of the vacuum pump, and FIG. 6(*b*) shows a cross-section thereof.

FIGS. 6(*a*) and 6(*b*) show an arrangement of a vacuum pump 20, which constitutes a fourth embodiment of the present invention. FIG. 6(*a*) shows a front half of the vacuum pump 20, and FIG. 6(*b*) shows a cross-section thereof. Portions corresponding to the portions which have been described in connection with the first embodiment with reference to FIGS. 1(*a*), 1(*b*) are denoted by the same reference numerals, and the description therefor is omitted accordingly.

The turbo molecular pump 20 according to the fourth embodiment of the present invention has an intermediate cylinder 100 which is disposed between the inner cylinder 22 and the outer cylinder 23. This intermediate cylinder 100 is integrally formed on or fixed by welding to the bottom surface annular plate 24 at its lower end portion (i.e. its downstream side end portion).

The outer rotor type motor 33 is disposed substantially at the axially central portion of the intermediate cylinder 100, and the stator coil 34 is mounted onto the outer peripheral wall of the intermediate cylinder 100.

A communicating hole 101 is formed in the lower end portion of the intermediate cylinder 100 in the vicinity of the exhaust port 27 so as to communicate the inside and the outside of the intermediate cylinder 100 with each other.

The rotor 51 in this embodiment includes an outer rotor main body 110 disposed between the outer cylinder 23 and the intermediate cylinder 100, an inner rotor main body 111 disposed between the intermediate cylinder 100 and the inner cylinder 22, and a rotor annular plate (a connection plate) 112 in the form of annulus, which connects the rotor main bodies 110 and 111 to each other.

The outer rotor main body 110 is provided at its outer peripheral wall with outer rotor vanes 115 disposed in the multiple stages, and at its inner peripheral wall with the rotor 35 of the motor 33 which is confronted with the stator coil 34. The outer rotor vane 115 of each stage has a plurality of outer rotor blades (wings) 116 open at their radially outer sides. Each of the outer rotor blades 116 extends radially and inclined at a predetermined angle with respect to the rotational axis of the rotor 51.

The inner rotor main body 111 is provided at its inner peripheral wall with inner rotor vanes 118 disposed in the multiple stages. The bearings 59 and 60 are disposed between the outer peripheral wall of the inner rotor main body 111 and the inner peripheral wall of the intermediate cylinder 100 and located at respective upper and lower end sides. The inner rotor vane 118 of each stage has a plurality of inner rotor blades (wings) 119 open at their radially inner sides (at the central axis side). Each of the inner rotor blades 119 extends radially and inclined at a predetermined angle with respect to the rotational axis of the rotor 51.

Similarly to the first embodiment of the present invention shown in FIGS. 2 and 3, the turbo molecular pump 20 thus constructed is installed in such a manner that the outer flange 38 is connected to the chamber by the bolts 81 and the inner flange 28 is connected to the mounting plate 73 by bolts 83, thereby forming the vacuum apparatus.

In the turbo molecular pump 20 and the vacuum apparatus thus constructed, the motor 33 rotates the rotor 51 in the direction indicated by the arrow R at the high speed of the rated value (20,000 to 50,000 r.p.m.), to thereby rotate the outer rotor vanes 115 and the inner rotor vanes 118 at high speed. Consequently, the processing gas or the like within the chamber 70 is discharged therefrom through the exhaust port 75 and the intake port 26 of the turbo molecular pump 20, passed as two system flows through the inner and outer sides of the rotor 51 by the action of by outer rotor vanes 115 and the inner rotor vanes 118 and then discharged to the lower side in the drawing. Thereafter, the gaseous molecule discharged to the downstream side by the action of the inner rotor vanes 118 is passed through the communication hole 101, and discharged to the exhaust pipe 89 connected to the exhaust port 27 together with the gaseous molecule discharged to the downstream side by the action of the outer rotor vanes 115.

In the first embodiment of the present invention, the flange 53 and the threaded groove 56 are provided as the sealing mechanism for preventing the reverse flow of the exhaust gas since the inner side of the rotor main body 52 does not perform the exhaust action. In contrast, this embodiment has not only the outer rotor vanes 115 on the outer peripheral side of the rotor 51 but also the inner rotor vanes 118 on the inner peripheral side thereof, so that the exhaust action can be performed on the inner side of the rotor 51. Accordingly, it is possible to completely prevent the reverse flow of the exhaust gas.

Similarly to the second and third embodiment of the present invention described with reference to FIGS. 4 and 5, the fourth embodiment of the present invention may adopt the combined structure of the turbo molecular pump with the threaded groove pump, or the combined structure of the turbo molecular pump with the centrifugal flow type pump.

Next, a fifth embodiment of the present invention will be described hereafter.

Figures 7A, 7B:
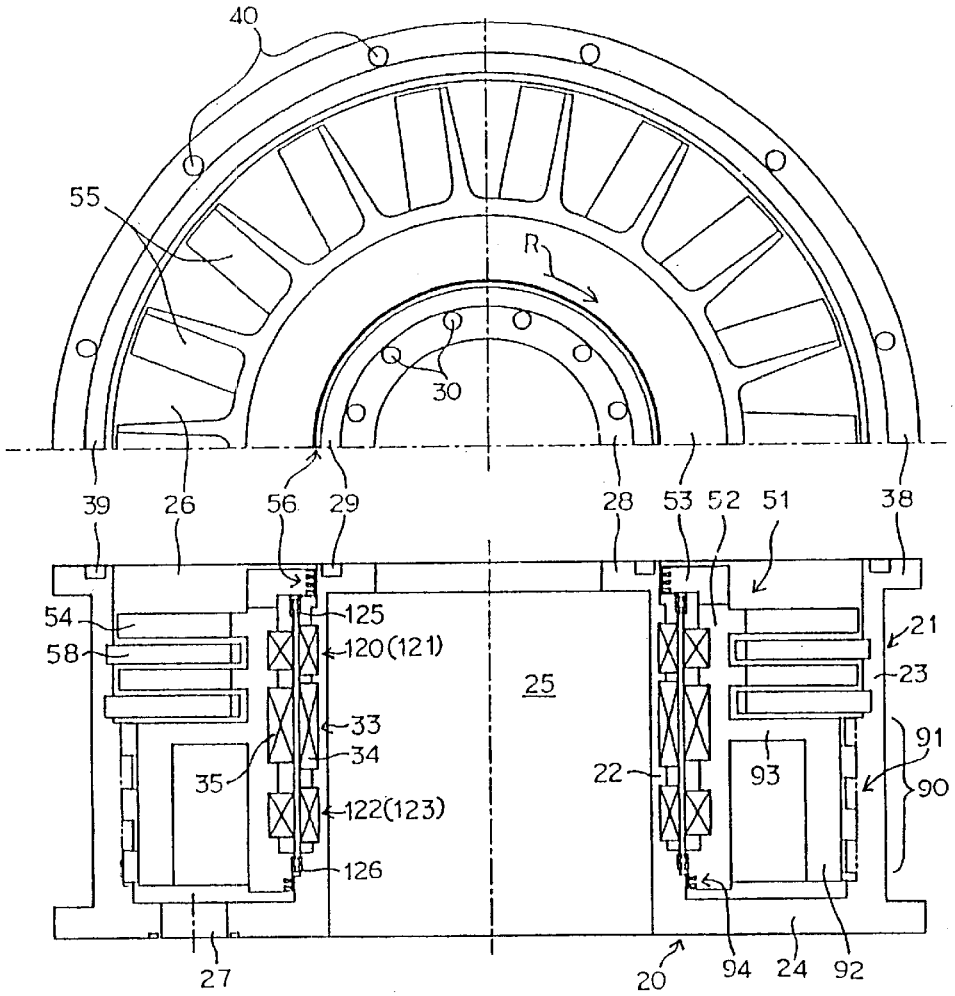
FIGS. 7(*a*) and 7(*b*) show an arrangement of a vacuum pump which constitutes a fifth embodiment of the present invention, in which FIG. 7(*a*) shows a front half of the vacuum pump, and FIG. 7(*b*) shows a cross-section thereof.
Figure 8:
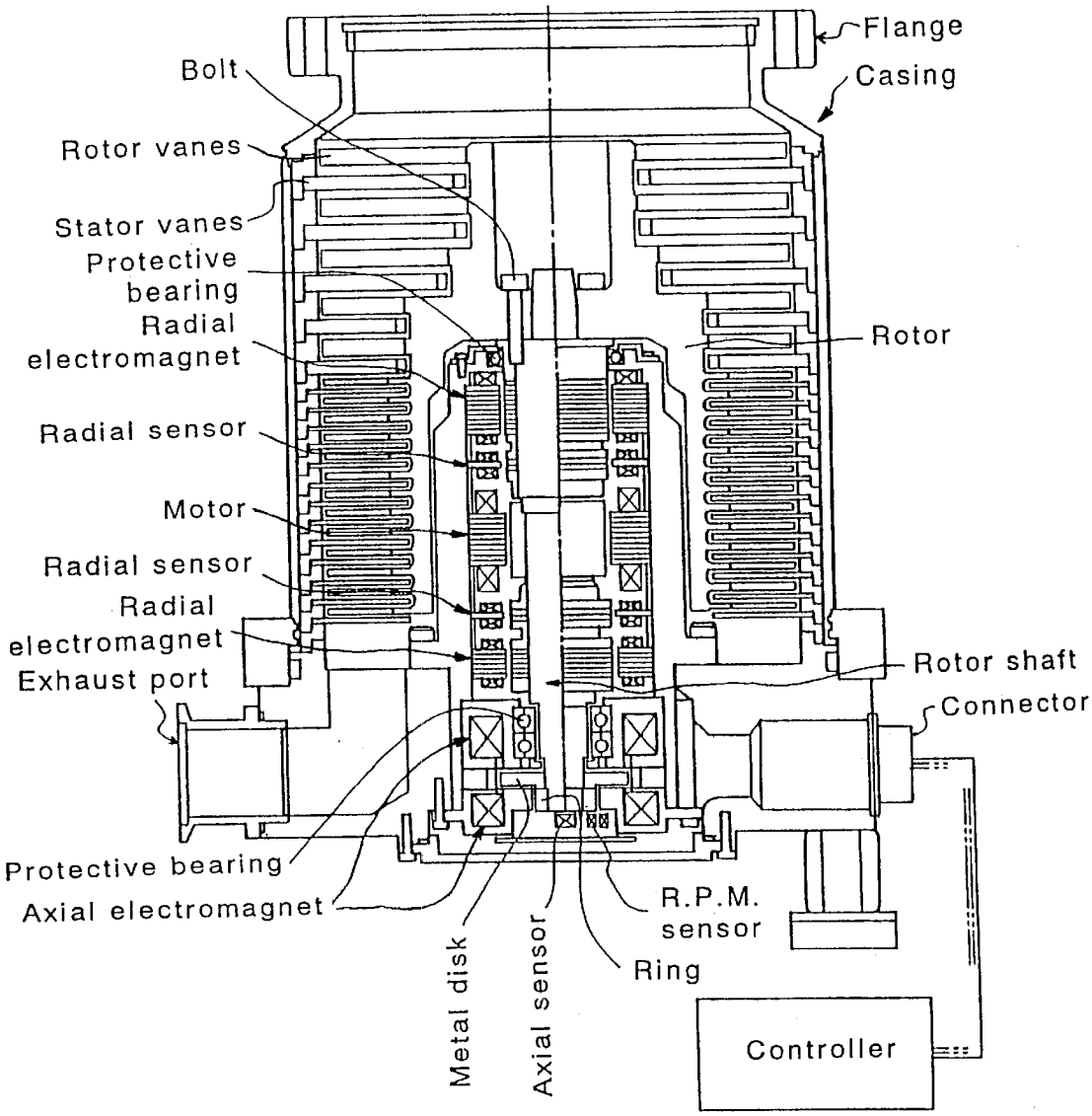
FIG. 8 is a cross-sectional view showing an arrangement of a typical turbo molecular pump.
Figure 9:
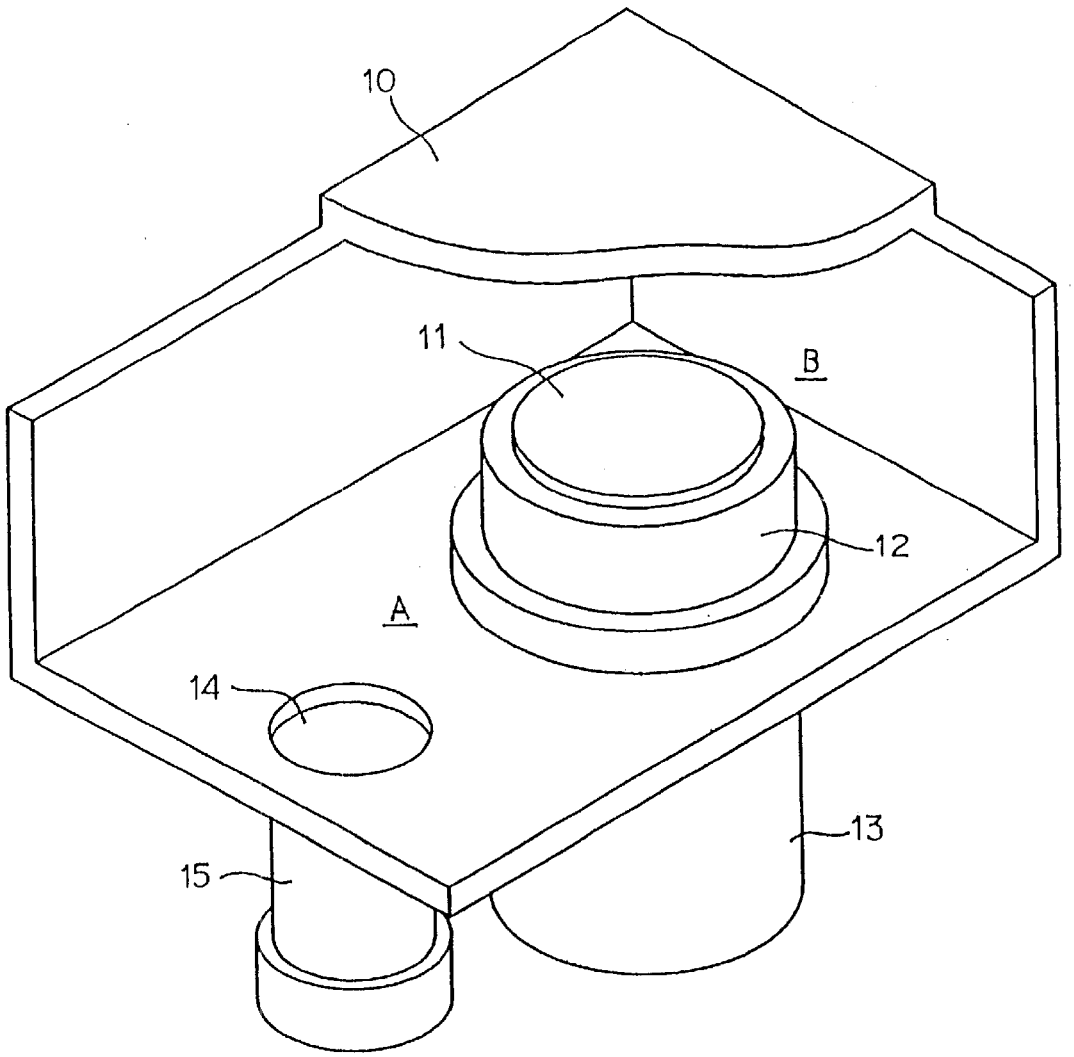
FIG. 9 is an explanatory view showing a general arrangement of a typical vacuum apparatus in which the typical turbo molecular pump is mounted to a chamber.
Figure 10:
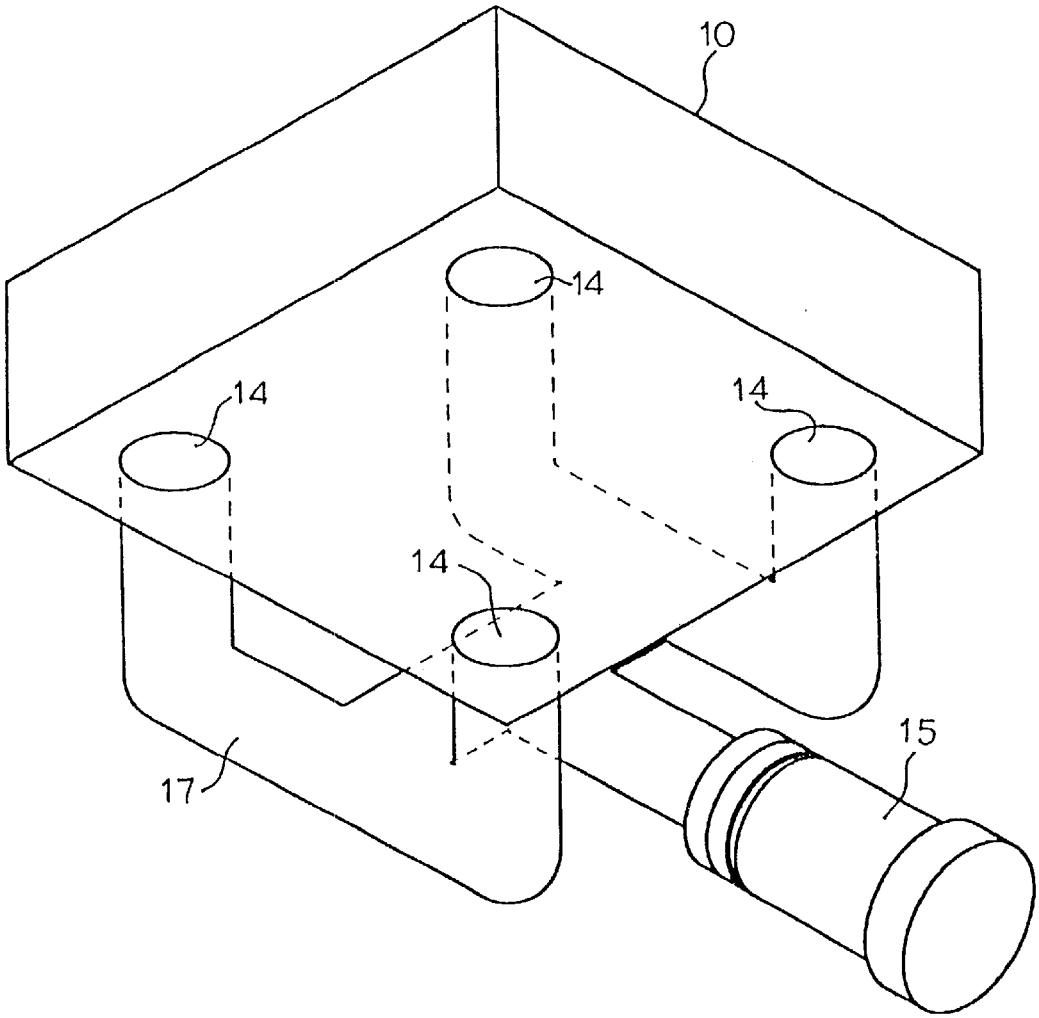
FIG. 10 is an explanatory view showing another typical vacuum apparatus.
Figure 11:
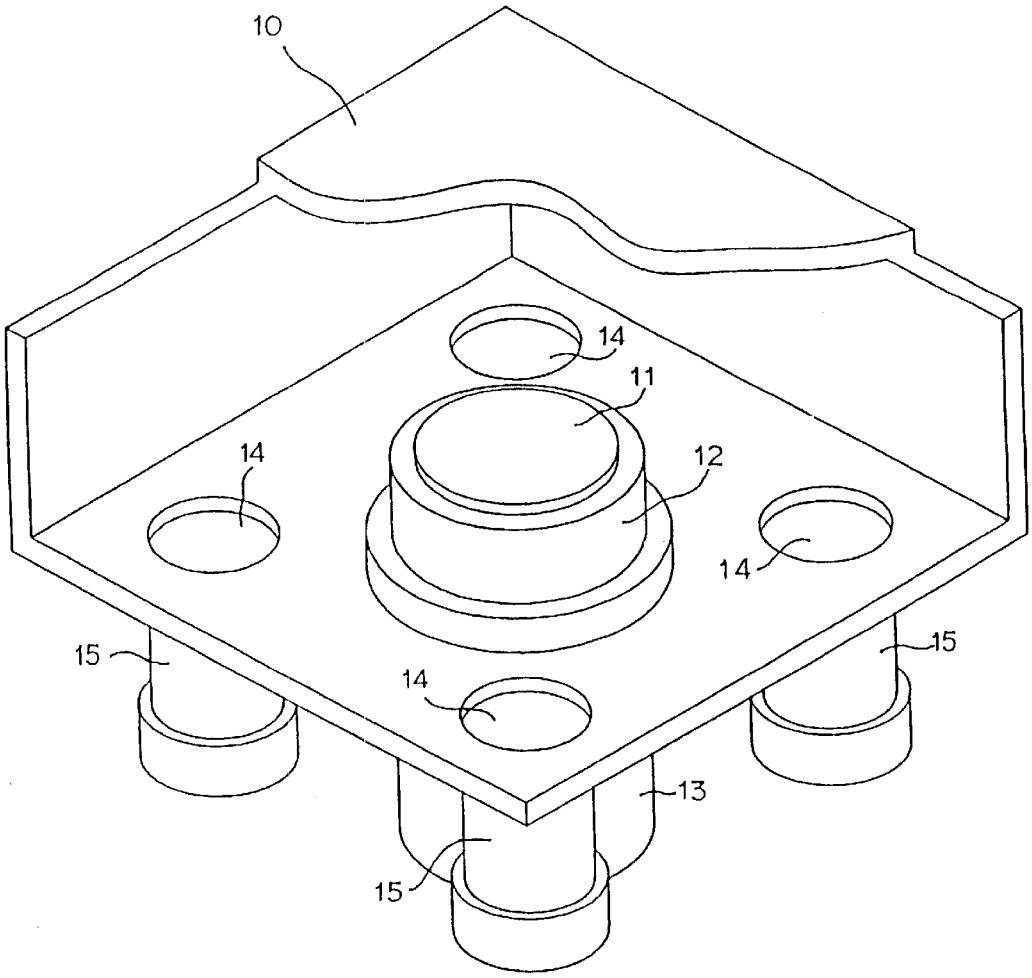
FIG. 11 is an explanatory view showing yet another typical vacuum apparatus.
Figure 12:
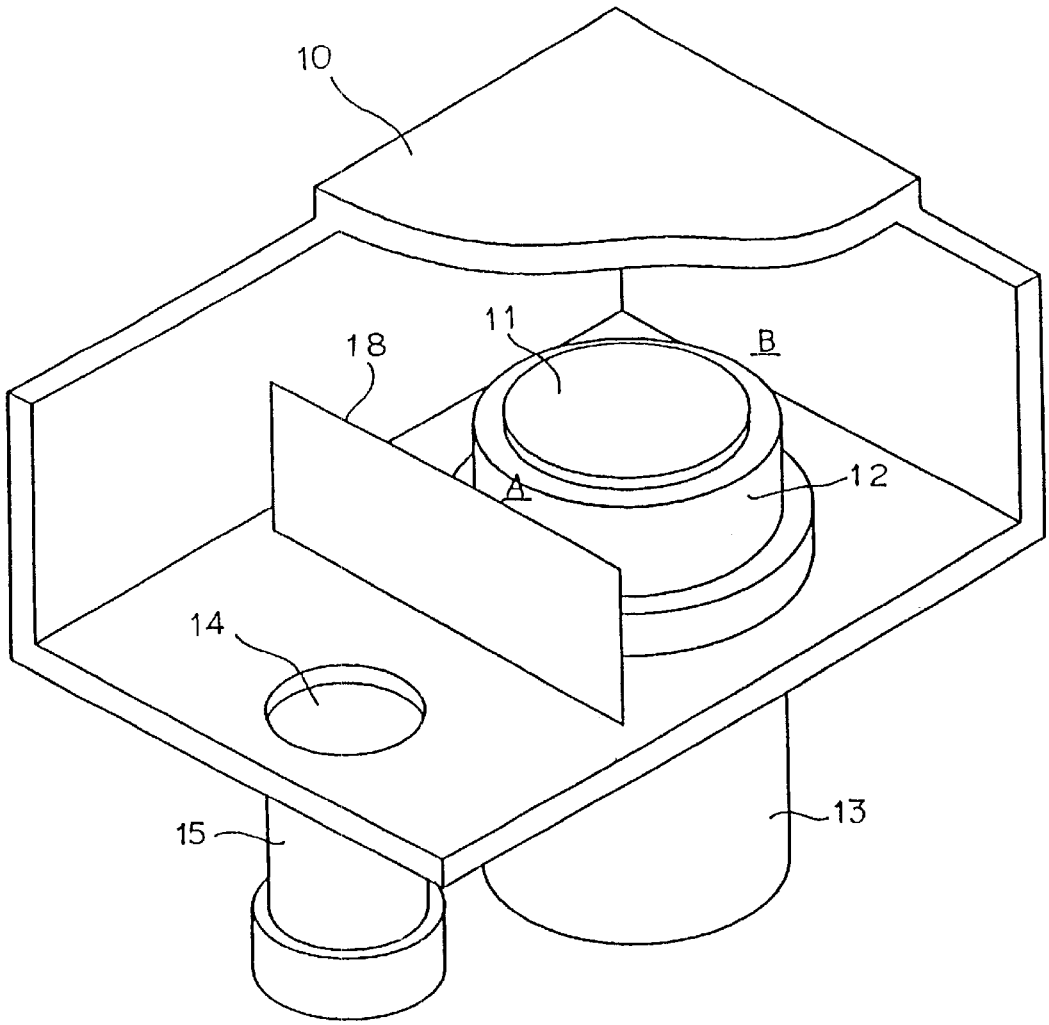
FIG. 12 is an explanatory view showing still another typical vacuum apparatus.

FIGS. 7(*a*) and 7(*b*) shows an arrangement of a vacuum pump 20, which constitutes a second embodiment of the present invention. FIG. 7(*a*) shows a front half of the vacuum pump 20, and FIG. 7(*b*) shows a cross-section thereof. Portions corresponding to the portions which have been described in connection with the first embodiment with reference to FIGS. 1(*a*),1(*b*) are denoted by the same reference numerals, and the description therefor is omitted accordingly.

The basic construction of the vacuum pump 20 according to the fifth embodiment of the present invention is similar to the vacuum pump of the second embodiment of the present invention shown in FIG. 4, which is a composite pump in which the turbo molecular pump is combined with the threaded groove pump.

This vacuum pump 20 uses a five-directional-control, magnetic bearing as the bearing between the inner cylinder 22 and the rotor main body 52. That is, a pair of radial magnetic bearings 120 and 121 are disposed on the upstream side of the motor 33 to receive radial loads of two directions, whereas a pair of radial magnetic bearings 122 and 123 are disposed on the downstream side thereof to receive radial loads of two directions. Further, a thrust magnetic bearing (not-shown) is disposed to receive an axial load of one direction. Protective bearings 125 and 126 are respectively disposed on the upstream side of the radial magnetic bearing 120 and the downstream side of the radial magnetic bearing 122 so as to protect the turbo molecular pump 20 from the so-called touch-down of the magnetic bearing device. The protective bearings 125 and 126 are in non-contact relation to the inner cylinder 22 or the rotor main body 52 during the normal operation.

Each of the radial magnetic bearings 120–121 (and the thrust magnetic bearing) has an electromagnet for generating a magnetic force in the radial direction (and in the axial direction) and a sensor for detecting the position of the rotor main body 52 in the radial direction (and in the axial direction). The exciting current is supplied to each of the electromagnet to magnetically float the rotor main body 52. At the time of the magnetic float, the exciting current is controlled based on the position detection signal from each of the sensors so that the rotor main body 52 is held at a predetermined position in the radial direction (and in the axial direction).

The use of the magnetic bearing eliminates the mechanical contact portion, and thus no particle or dust is generated. Further, the oil for sealing or the like can be dispensed with, so that no gas is generated. Thus, it is possible to realize the operation under a clean environment, and the apparatus using the magnetic bearing is suitable for cases where high degree of cleanness is required, such as the manufacturing of the semiconductors.

The use of the magnetic bearing as the bearing of the vacuum pump 20 is applicable to each of the first, third and fourth embodiments of the present invention similarly.

As described above, in each of the embodiments of the present invention, the hollow portion 25 is formed, which can accommodate therein various equipments, such as the drive mechanism 86, to be installed outside the chamber 70, and the annular intake port 26 is formed to extend along the entire outer periphery of the hollow portion 25. Therefore, it is possible to realize the uniform pressure distribution entirely inside of the exhaust port 75 within the chamber 70.

As described above, according to the present invention, it is possible to make the pressure distribution around the stage uniform.

What is claimed is:

1. A vacuum pump comprising:

an outer casing having a first end side, a second end side, an inner cylinder, an outer cylinder disposed over the inner cylinder, and a bottom surface plate closing a gap between the outer cylinder and the inner cylinder at the second end side, the inner cylinder having a hollow portion in communication with atmospheric air, an upper side, an inner flange disposed on an end portion of the upper side, and an inner sealing groove disposed on an upper end surface of the inner flange, and the outer cylinder having an upper side, an outer flange disposed on an end portion of the upper side of the outer cylinder, and an outer sealing groove disposed on an upper end surface of the outer flange;

an exhaust port disposed at the second end side of the outer casing;

a rotor main body disposed between the inner cylinder and the outer cylinder;

a bearing supporting the rotor main body;

a motor for rotating the rotor main body, the motor being disposed at one of a first position between the inner cylinder and the rotor main body and a second position between the outer cylinder and the rotor main body; and a pump mechanism for pumping gaseous molecules from an intake port disposed at the first end side of the outer casing to the exhaust port to discharge the gaseous molecules from the exhaust port, the pump mechanism being disposed at one of a first position between the inner cylinder and the rotor main body and a second position between the outer cylinder and the rotor main body.

2. A vacuum pump as set forth in claim 1; further comprising a non-contact sealing mechanism disposed at least one of the first end side and the second end side of the outer casing for preventing a reverse flow of the gaseous molecules to the other of the first and second positions where the pump mechanism is not disposed.

3. A vacuum pump as set forth in claim 1; further comprising a threaded groove mechanism, a blade disposed on the rotor main body, and a disk disposed on the rotor main body; and wherein the pump mechanism applies a vector momentum to the gaseous molecules using one or a combination of the threaded groove mechanism, the blade and the disk to discharge the gaseous molecules from the exhaust port.

4. A vacuum pump as set forth in claim 1; wherein the pump mechanism comprises a volume transferring-type pump mechanism.

5. A vacuum pump as set forth in claim 1; wherein the bearing comprises a magnetic bearing.

6. A vacuum pump as set forth in claim 1; wherein the inner sealing groove of the inner cylinder and the outer sealing groove of the outer cylinder are generally annular-shaped.

7. A vacuum pump comprising:

an outer casing having a first end side, a second end side, an inner cylinder having a hollow portion in communication with atmospheric air, an intermediate cylinder disposed outside of the inner cylinder, an outer cylinder disposed outside of the intermediate cylinder, and a bottom surface plate closing a gap between the inner cylinder and the intermediate cylinder and a gap between the intermediate cylinder and the outer cylinder at the second end side;

an exhaust port disposed at the second end side of the outer casing;

a communication hole disposed at the second end side of the intermediate cylinder;

a rotor main body having an inner rotor main body disposed between the inner cylinder and the intermediate cylinder, an outer rotor main body disposed between the intermediate cylinder and the outer cylinder, and a connection plate connecting the inner rotor main body and the outer rotor main body to each other at an upper side of the intermediate cylinder;

a bearing supporting the rotor main body;

a motor for rotating the rotor main body, the motor being disposed at one of a first position between the intermediate cylinder and the inner rotor main body and a second position between the intermediate cylinder and the outer rotor main body; and a pump mechanism for pumping gaseous molecules from an intake port disposed at the first end side of the outer casing to the exhaust port to discharge the gaseous molecules from the exhaust port, the pump mechanism being disposed at one of a first position between the inner rotor main body and the inner cylinder and a second position between the outer rotor main body and the outer cylinder.

8. A vacuum pump as set forth in claim 7; further comprising a threaded groove mechanism, a blade disposed on the rotor main body, and a disk disposed on the rotor main body; and wherein the pump mechanism applies a vector momentum to the gaseous molecules using one or a combination of the threaded groove mechanism, the blade and the disk to discharge the gaseous molecules from the exhaust port.

9. A vacuum pump as set forth in claim 7; wherein the pump mechanism comprises a volume transferring-type pump mechanism.

10. A vacuum pump as set forth in claim 7; wherein the bearing comprises a magnetic bearing.

11. A vacuum apparatus comprising:

a vacuum pump as set forth in claim 3;

a container having an annular exhaust port and being connected to the first end side of the outer casing of the vacuum pump so that the annular exhaust port is disposed in fluid communication with the intake port of the vacuum pump;

a stage disposed inside of the container through the exhaust port thereof; and a stage drive mechanism disposed outside of the container for driving the stage, the stage drive mechanism being disposed in the hollow portion of the inner cylinder of the vacuum pump.

12. A vacuum apparatus comprising:

an outer casing having a first end side, a second end side, an inner cylinder having a hollow portion in communication with atmospheric air, an outer cylinder disposed over the inner cylinder, and a bottom surface plate closing a gap between the outer cylinder and the inner cylinder at the second end side;

an exhaust port disposed at the second end side of the outer casing;

a rotor main body disposed between the inner cylinder and the outer cylinder;

a bearing supporting the rotor main body;

a motor for rotating the rotor main body, the motor being disposed at one of a first position between the inner cylinder and the rotor main body and a second position between the outer cylinder and the rotor main body;

a pump mechanism for pumping gaseous molecules from an intake port disposed at the first end side of the outer casing to the exhaust port to discharge the gaseous molecules from the exhaust port, the pump mechanism being disposed at one of a first position between the inner cylinder and the rotor main body and a second position between the outer cylinder and the rotor main body;

a container having an annular exhaust port and being connected to the first end side of the outer casing so that the annular exhaust port is disposed in fluid communication with the intake port;

a stage disposed inside of the container through the exhaust port thereof; and a stage drive mechanism disposed outside of the container and in the hollow portion of the inner cylinder for driving the stage.

13. A vacuum pump comprising: an inner cylinder having a hollow portion in fluid communication with atmospheric air, an inner flange disposed on an upper side of the inner cylinder, and an inner sealing groove disposed on an upper end surface of the inner flange; an outer cylinder disposed over the inner cylinder, the outer cylinder having an outer flange disposed on an upper side of the outer cylinder, and an outer sealing groove disposed on an upper end surface of the outer flange; an intake port disposed at the upper side of the inner and outer cylinders; an exhaust port disposed at lower sides of the inner and outer cylinders; a rotor main body disposed between the inner and outer cylinders; a bearing rotationally supporting the rotor main body; a motor for rotating the rotor main body; and a pump mechanism for pumping gaseous molecules from the intake port to the exhaust port to discharge the gaseous molecules from the exhaust port.

14. A vacuum pump according to claim 13; wherein the inner sealing groove of the inner cylinder and the outer sealing groove of the outer cylinder are generally annular-shaped.

15. A vacuum pump according to claim 13; wherein the pump mechanism is disposed between the inner cylinder and the rotor main body.

16. A vacuum pump according to claim 13; wherein the pump mechanism is disposed between the outer cylinder and the rotor main body.

17. A vacuum pump according to claim 13; further comprising a bottom surface plate closing a gap between the outer cylinder and the inner cylinder at the lower sides thereof.

18. A vacuum pump according to claim 13; wherein the motor is disposed between the inner cylinder and the rotor main body.

19. A vacuum pump according to claim 13; wherein the motor is disposed between the outer cylinder and the rotor main body.

20. A vacuum apparatus comprising: a vacuum pump as set forth in claim 13; a container having a chamber and an exhaust port communicating the chamber with the intake port of the vacuum pump so that the inner sealing groove of the inner cylinder and the outer sealing groove of the outer cylinder seal the chamber from the atmospheric air; a stage disposed in the chamber of the container for supporting a sample; and a stage drive mechanism disposed in the hollow portion of the inner cylinder of the vacuum pump for driving the stage.

21. A vacuum pump comprising: an inner cylinder having a hollow portion in fluid communication with atmospheric air; an intermediate cylinder disposed over of the inner cylinder, the intermediate cylinder having an inner space and a communication hole for communicating the inner space to an exterior of the intermediate cylinder; an outer cylinder disposed over the intermediate cylinder; an intake port disposed at upper sides of the inner and outer cylinders; an exhaust port disposed at lower sides of the inner and outer cylinders; a rotor main body having an inner rotor main body disposed between the inner cylinder and the intermediate cylinder, an outer rotor main body disposed between the intermediate cylinder and the outer cylinder, and a connection plate connecting the inner rotor main body and the outer rotor main body to each other; a bearing rotationally supporting the rotor main body; a motor for rotating the rotor main body; and a pump mechanism for pumping gaseous molecules from the intake port to the exhaust port to discharge the gaseous molecules from the exhaust port.

22. A vacuum pump according to claim 21; wherein the pump mechanism is disposed between the inner cylinder and the rotor main body.

23. A vacuum pump according to claim 21; wherein the pump mechanism is disposed between the outer cylinder and the rotor main body.

24. A vacuum pump according to claim 21; further comprising a bottom surface plate closing a gap between the inner cylinder and the intermediate cylinder and a gap between the intermediate cylinder and the outer cylinder at the lower sides of the inner and outer cylinders.

25. A vacuum pump according to claim 24; wherein the intermediate cylinder is integrally connected to the bottom surface plate.

26. A vacuum pump according to claim 21; wherein the motor is disposed between the inner cylinder and the rotor main body.

27. A vacuum pump according to claim 21; wherein the motor is disposed between the outer cylinder and the rotor main body.

28. A vacuum apparatus comprising: a vacuum pump as set forth in claim 21; a container having a chamber and an exhaust port communicating the chamber with the intake port of the vacuum pump; a stage disposed in the chamber of the container for supporting a sample; and a stage drive mechanism disposed in the hollow portion of the inner cylinder of the vacuum pump for driving the stage.

* * * * *